United States Patent [19]

Kucharczyk

[11] Patent Number: 4,611,531

[45] Date of Patent: Sep. 16, 1986

[54] VENTILATION APPLIANCE

[75] Inventor: Eckhard Kucharczyk, Wilnsdorf, Fed. Rep. of Germany

[73] Assignee: Siegenia-Frank, KG, Siegen, Fed. Rep. of Germany

[21] Appl. No.: 689,181

[22] Filed: Jan. 7, 1985

[30] Foreign Application Priority Data

| | | | |
|---|---|---|---|
| Jan. 14, 1984 | [DE] | Fed. Rep. of Germany | 8400940[U] |
| Nov. 15, 1984 | [DE] | Fed. Rep. of Germany | 3441769 |
| Dec. 12, 1984 | [DE] | Fed. Rep. of Germany | 3441769 |

[51] Int. Cl.[4] ..... F24F 7/00

[52] U.S. Cl. ..... 98/39.1; 415/119

[58] Field of Search ..... 98/39.1, 42.02, 42.07, 98/42.08, 42.09, 41.3, DIG. 10; 415/119, 206

[56] References Cited

U.S. PATENT DOCUMENTS

| | | | |
|---|---|---|---|
| 2,466,851 | 4/1949 | Honekamp et al. | 98/41.3 X |
| 3,174,682 | 3/1965 | Wilfert et al. | 415/119 |
| 3,799,703 | 3/1974 | Paine et al. | 98/42.02 |
| 4,023,472 | 5/1977 | Grunder et al. | 98/39.1 |
| 4,518,311 | 5/1985 | Dernedde et al. | 415/206 |

FOREIGN PATENT DOCUMENTS

| | | | |
|---|---|---|---|
| 2946903 | 6/1981 | Fed. Rep. of Germany | 415/119 |
| 7402356 | 8/1975 | Netherlands | 415/119 |
| 439569 | 12/1967 | Switzerland | 415/119 |
| 1486461 | 9/1977 | United Kingdom | 415/119 |

*Primary Examiner*—Harold Joyce

*Attorney, Agent, or Firm*—Blodgett & Blodgett

[57] ABSTRACT

A ventilation appliance for rooms having a box-like housing which can be used either as a ventilator with a radial fan or a pressure differential ventilator without such a fan. The configuration of the applicance insures a good sound damping action even when only short flow path are available in the housing or when, for functional reasons, the housing cannot be lined with sound damping material. For this purpose and enveloping spiral 21 for the blower wheel of the radial fan is formed directly from a block-like insert body of sound damping material such a plastic foam or foam rubber, the enveloping spiral having formed thereon an approximately tangential and/or radially connecting air connecting conduit. A replaceable filter for such a ventilation device is disclosed. A possible explanation is indicated for an unexpectedly effective mixing of entering air with room air upon installation of such a ventilating appliance.

10 Claims, 5 Drawing Figures

VENTILATION APPLIANCE

BACKGROUND OF THE INVENTION

This invention relates to a ventilation appliance for rooms with a radial fan arranged in a box-shaped housing and an enveloping spiral column encircling the blower wheel inside the housing, formed as an insert body.

In ventilation appliances for rooms it is already known, for example as disclosed in DE-OS 30 17 431, to arrange a radial fan in a box-like housing the radial fan consisting of the blower wheel itself and encircled by an enveloping spiral. The radial fan is detachably arranged in the box-like housing.

A deficiency in known ventilation appliances lies in the fact that both the blower wheel and the encircling, enveloping spiral are constructed entirely of rigid (reverberative) material, such as sheet metal.

Significant sound-deadening effect can therefore only be obtained in known ventilation appliances when special linings, formed out of sound deadening material, are applied to the air conducting conduits at the back of the radial fan itself in the box-like housing.

For functional reasons it is not always possible to provide sound deadening linings in the flow ducts at the back of the radial fan. Moreover, there is frequently not enough space beyond the radial fan inside the box-like housing to arrange sound deadening, lined, flow ducts of sufficient lengths to acheive significant sound deadening effect.

The instant invention has, as a primary objective, to provide a room ventilating appliance of the above described type that acheives a good sound deadening effect even when no long flow paths are available within the box-like housing, or when, for functional reasons, the paths cannot be provided with sound deadening linings.

BRIEF SUMMARY OF THE INVENTION

The instant invention provides that the enveloping spiral for the blower wheel, and an approximately tangential and/or radial ajoining air conducting conduit, be directly formed by an insert body made out of sound deadening material such as plastic foam or foam rubber.

A further feature of the invention provides that the wall of the enveloping spiral which lies opposite to an air outlet of the housing and is connectable with the outside air, comprises a platelike, flat, insert body of sound deadening material such as plastic foam or foam rubber. A holder plate abuts at the inside of this body, formed of reverberant material on which the stator of the radial fan is mounted. By this means, a damping of high and low audible frequencies is attained in the operative range of the radial fan.

The invention also involves a particularly favorable configuration of the ventilation appliance in which the plate-like, flat, insert body covers only that part of the air-conducting conduit that ajoins tangentially onto the enveloping spiral. The radial part thereof has a clearance over its whole length from the oppositely lying front wall of the housing and/or from a sound deadening layer located on the housing. A laterally directed flow distribution of air can be obtained which yields another improvement of the sound dampening effect.

A further aspect of the invention is a provision of a favorable flow distribution inside of the box-like housing by providing bevels on the longitudinal sides of the insert body which contain the enveloping spiral and the air conducting conduit. The bevels are provided at least over the longitudinal section which contains the radial part of the air conducting conduit. The bevels run by acute angles to the neighboring longitudinal walls of the housing.

Air outlets (for example, lattices of perforations) are located at that point in the longitudinal housing walls.

Another important feature of the ventilation appliance of the present invention is the provision of a swivel flap as closing and air conducting member, at least in the region of the air outlets. Such a flap is provided between each longitudinal housing wall and the neighboring longitudinal side of the insert body which is inclined thereto. Each such swivel flap is supported at the longitudinal housing wall near the rear wall and consists of a profile that has two legs lying at an obtuse angle to one another. The angular distance of the legs from one another is coordinated to the angle between the front face and the longitudinal side of the insert body which contains the enveloping spiral and the air conducting conduit and which is inclined thereto.

For the purpose of simple actuation, the invention also provides that each swivel flap is adjustable between its closing position and its open position by means of a crankpin through a rotary button or toggle that engages in a curved slot provided at the free leg of the swivel flap.

Simplicity of construction is achieved in the ventilation appliance of the present invention by the fact that the longitudinal side walls and the front wall of the box-shaped housing are formed, in each case, of extruded profiles of light metal or plastics. The partitions are constructed as formed parts by light metal die-casting or by plastic injection molding. The rear wall is a canted-off formed part, stamped out of sheet metal. The two longitudinal side walls of the box-shaped housing consist of mirror-inverted but otherwise identical, opposed, extruded profiles. The front wall is formed by two mirror-inverted, oppositely arranged extruded profiles along with a supplementary extruded profile coupling them with one another.

In many cases it is desirable or necessary that the air conveyed by the ventilation appliance be freed of particles of dust or noxious matter before its introduction to the room. For this reason it has proved particularly recommendable to provide a replaceable filter insert, comprising a folded or layered body having relatively little space requirement in order to provide a large filter surface that can be replaced at any time in a simple manner.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

The drawings illustrate a ventilation appliance for rooms which is particularly suited for arrangement on the inside of building walls; for example, in living rooms and work rooms. As can be clearly seen from FIG'S 1–3 the ventilation appliance is provided with the box-shaped housing 1 with a housing rear wall 2, two longitudinal housing walls 3' and 3'', 2 transverse housing walls 4' and 4'', as well as a front wall 5. In this embodiment, the housing rear wall 2 is constructed as a canted-off formed part, stamped out of sheet metal which has two longitudinal flanges 2' and 2''. The rear wall is provided in this case with a punched out, circular air passage opening 2''' (best seen in FIG. 2).

Figure 2:
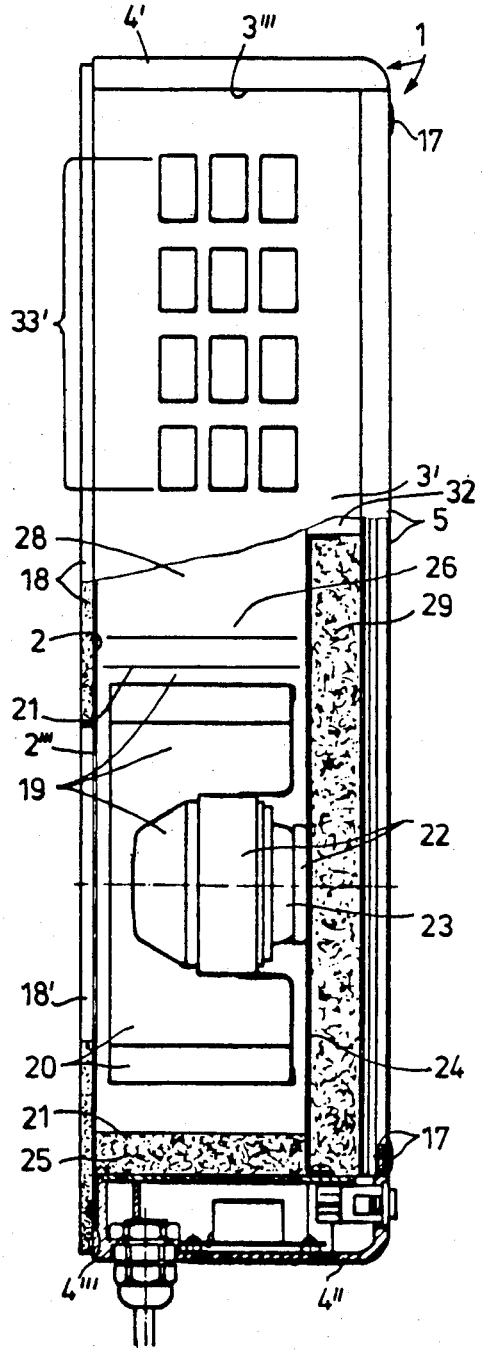
FIG. 2 shows the ventilation appliance of FIG. 1 in partial, sectional cuts.

The two transverse housing walls 4' and 4'' are detachably connected to the housing rear wall 2, by means of screws at the opposite transverse edges. It is preferable to construct the transverse housing walls 4' and 4'' as formed parts by light metal die-casting or a plastic injection molding, whereby reinforcing ribs may be provided in a simple manner on relatively thin walls. The walls are provided with perforations, hollow spaces, and chambers for containing electrical switch and installation elements. This is illustrated in FIG. 2 in connection with the transverse housing wall 4''.

The housing rear wall 2 engages with its transverse edges in each case in the bead-like shoulders 4''' of the transverse housing walls 4' and 4''. This is illustrated in FIG. 2 in connection with the transverse housing wall 4''. This assures an exact alignment of the tranverse housing walls 4' and 4'' relative to the housing rear wall 2.

The longitudinal housing walls 3' and 3'' are preferably constructed of light metal or plastic extruded profiles. These profiles are in each case provided with rearwardly extending profile webs 6' and 6'' at least along or near the longitudinal edges. This can best be seen in FIG. 4. The profile web 6' is so shaped that it defines, by means of a hook-like profile nose 7', a longitudinal slot 8 which is open towards the longitudinal edge 9 of the longitudinal housing walls 3' and 3''. The two beveled longitudinal flanges 2' and 2'' of the housing rear wall 2 engage in these longitudinal slots 8 of the longitudinal housing walls 3' and 3'', as can be clearly seen in FIG'S. 3 and 4.

Figure 4:
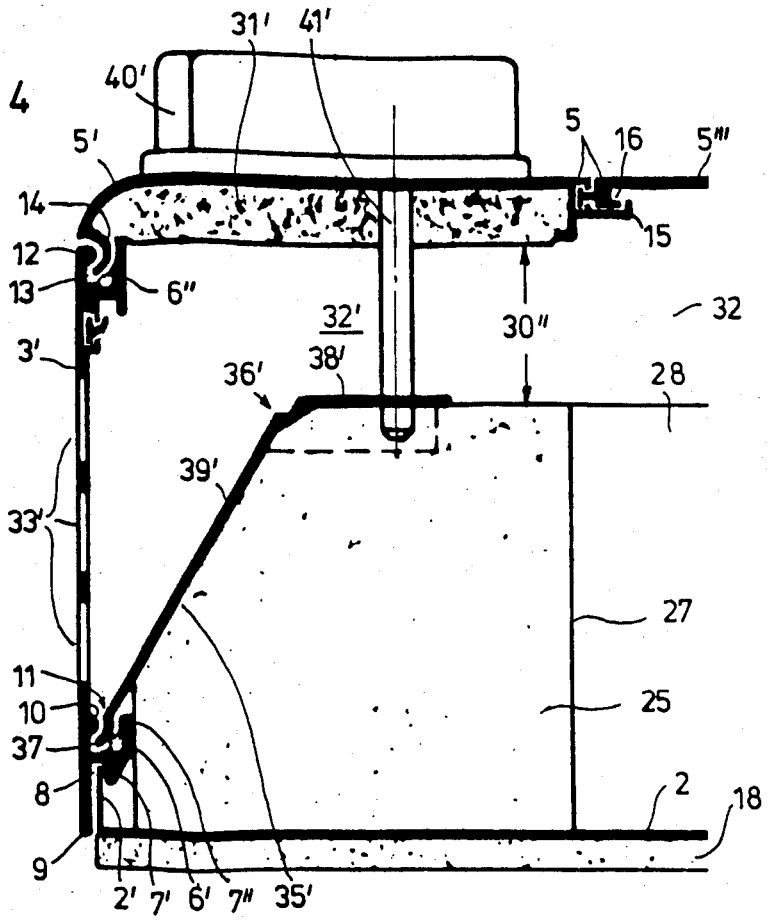
FIG. 4 is an enlarged view of the portion of FIG. 3.

Another profile nose 7' of profile web 6' is directed towards the opposite side. This nose 7'', along with a bead 10 located directly at the inside of the longitudinal housing walls, defines a groove 11 having a partial circular cross-section as seen in FIG. 4.

Likewise, profile web 6'' is so arranged and developed that, together with a bead lying directly at the second longitudinal edge 12 of the longitudinal housing 3' and 3'', it defines a groove 13, also having a partial circular cross-section. Each longitudinal housing wall and 3' and 3'' engages, with its 2 transverse edges 3''', in bead-like indentations in the transverse housing walls 4' and 4''. These are designed similarly to the bead-like indentations 4''' provided for the transverse edges of the housing rear wall 2.

Figure 3:
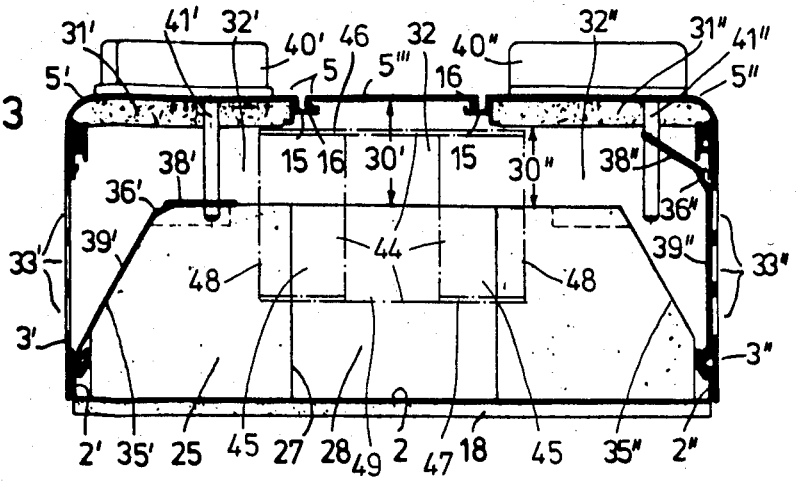
FIG. 3 is a cross-section of the ventilation appliance along the line III—III, of FIG. 1.

The housing front wall 5 is composed of several extruded profiles arranged parallel to one another and which may likewise consist of light metal or plastic. In this case the front wall is formed of at least two extruded profiles 5' and 5'' which are mirror-inverted and opposed to one another. In the illustrated embodiment, the two extruded profiles 5' and 5'' are coupled with one another through an intermediate, third extruded profile 5''' as best can be seen from FIG. 3. Moreover, the extruded profiles 5', 5'', and 5''' (or the housing front wall 5 which they form) engage with their transverse edges, for security of position, in bead-like indentations which lie at the boundary rim of the transverse housing walls 4' and 4''. These correspond to the bead-like indentations 4'' as can best seen in FIG. 1. In each case the two mirror-inverted, opposed, extruded profiles 5'' and 5' can be pivoted into the circularly profiled longitudinal slots 13 of the longitudinal housing walls 3' and 3'' by means of coupling webs 14 which are integrally formed on the profiles and which have a corresponding partial circular cross-section. This is best seen in FIG. 4. These two profiles are then connected through the third extruded profile 5''' at the longitudinal edges which face one another. This connection is through stop webs 15 and 16 which are designed for reciprocal engagement so that the outside surfaces all the extruded profiles 5', 5'', and 5''' of the housing front wall 5 lie in the same plane. The surface passes over, through a radius of curvature to the longitudinal housing walls 3' and 3'' as shown in FIG. 3. The securely held connection, both of the longitudinal housing walls 3', 3'', and of all the extruded profiles 5', 5'', and 5''' of the housing front wall 5, with the two transverse housing walls 4' and 4'' can be effected simply by means of rotatable casement-type locks 17. These may be supported near the tranverse edges of the extruded profile 5''' and can be pivoted with their tongues into corresponding pockets in the transverse housing walls 4' and 4'' by applying an initial tension.

The outer surface of the housing rear wall 2 is covered with a vibration-damping coating 18 such as a thin layer of elastic/plastic foam or foam rubber. This coating is provided in alignment position with the air passage opening 2''' of the housing rear wall 2 by means of an appropriate cut-out 18'.

Inside the box-shaped housing, a radial fan 19 is arranged between the housing rear wall 2, the two longitudinal housing walls 3', 3'', and the housing front wall 5 as is best seen in FIG'S. 1 and 2. The radial fan 19 consists of a blower wheel 20 and an enveloping spiral 21 surrounding it, in which an electric motor 22 serves to drive the blower wheel 20. The stator 23 of the motor rests on a holding plate 24. The holding plate 24 for the stator 23 of the electric motor 22 is configured in the interior of the box-shaped housing 1 so that the blower wheel 20 is held in axial alignment with the air passage opening 2''' in the housing rear wall 2. The enveloping spiral 21 of the radial fan 19 is molded directly into a block-like insert body 25 which is composed of the sound deadening material, such as plastic foam or foam rubber. The insert body 25 also contains a section 26 which joins the enveloping spiral 21 in approximately tangential manner, and also joining there a section 27 of an air conducting conduit 28 directed radially towards the enveloping spiral 21 and towards the blower wheel 20 (see FIG. 1).

The aperture area of the enveloping spiral 21 (which lies opposite to the air passage opening 2''' in the housing rear walls 2 as well as the tangential institutional section 26 of the air conducting conduit 28 which follows the enveloping spiral 21) is closed off in the direction of the housing front wall 5 by the holder plate 24 on which is attached the stator of the electric motor 22 (which drives the blower wheel 20). In this preferred embodiment, the holder plate 24 consists of rigid (non-absorbing) material, such as sheet metal, and it rests on a plate-like flat insert body 29 made out of sound damping material, such as plastic foam or foam rubber. This is best shown in FIG. 2. The plate-like, flat insert body 29 is thus supported by the housing front wall 5 of the box-shaped housing 1. The holder plate 24 is elastically pressed against the adjacent front face of the insert body 25 which in its turn rests upon the housing rear wall 2.

The front face of the section of the insert body 25 which faces away from the housing rear wall 2 displays a certain clearance 30' or 30" from the housing front wall 5 as seen in FIG. 3. This section of the insert body contains the section 27 of the air conducting conduit 28 which is basically directed radially towards the enveloping spiral 21 or towards the blower wheel 20 of the radial fan 19. Thus, at least the areas of the housing front wall 5 formed by the extruded profiles 5' and 5" can be coated with layers 31' and 31" made out of sound-damping material such as plastic foam or foam rubber. The central extruded profile 5''' turns its non-absorbing surface in an advantageous manner towards the section 27 of the air conducting conduit 28.

Figure 1:
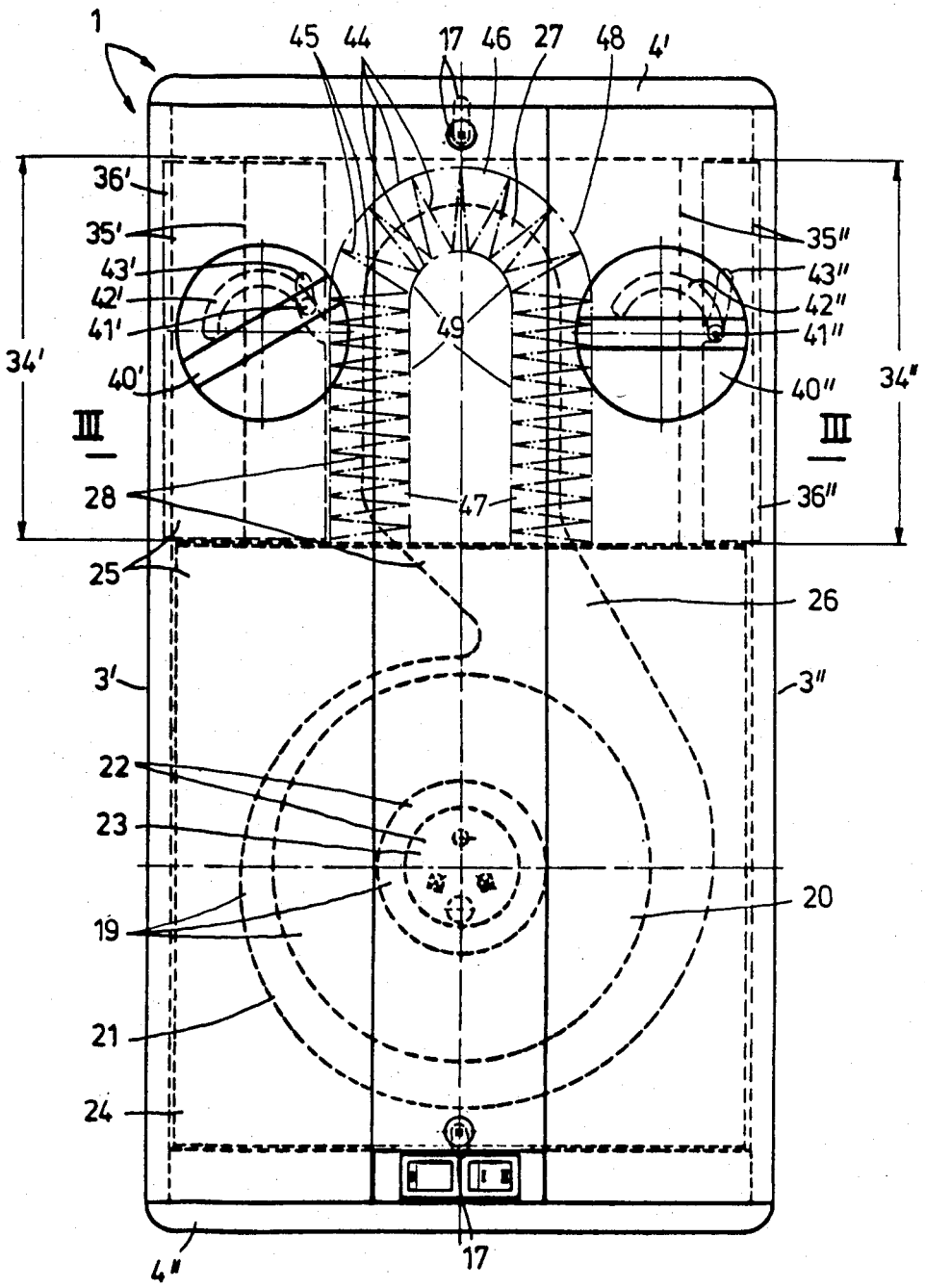
FIG. 1 is a front evelational view of a ventilation appliance according to the present invention.

The longitudinal section 27 of the air conducting conduit 28 (which is essentially radially directed towards the enveloping spiral 21 or towards the blower wheel 20) opens outside of the zone where the plate-like insert body 29 is installed into an air distribution chamber 32. The chamber has two distribution ducts 32' and 32" pointing in opposite directions leading respectively 2 longitudinal housing walls 3' and 3" as illustrated in FIG. 3. At the end of each of the air distribution ducts 32' and 32" each longitudinal housing wall 3' and 3" is provided with an air passage aperture such as the lattice of perforations 33', 33" shown in FIG'S. 2 and 3. In order that the lattices of perforations 33' and 33" provide a relatively large outflow surface, the longitudinal sides of the insert body 25 (which contains the enveloping spiral 21 and also the air conducting conduit 28) are provided with bevels 35', 35" which procede in an acute angle to the adjacent longitudinal housing wall 3', 3". Each are provided at least over the longitudinal sections 34' or 34" which display the radial part 27 of the air conducting conduit 28. This is best illustrated in FIG. 3. In this manner, it is possible to provide the longitudinal housing walls 3' and 3" with lattices of perforations 33' and 33" over a relatively large area. A correspondingly broad distribution of the airflow passing through is consequently obtained. Between each longitudinal housing wall 3', 3" and the adjacent longitudinal side of the insert body 25 which is inclined thereto, a respective swivel flap 36' or 36" is provided in the box-shaped housing, at least in the area of the lattices of perforations 33' and 33". On the one hand, each of these swivel flaps 36' and 36" serves as a closure member for blocking the passage of air through the lattices of perforations 33' or 33". On the other hand, in its open position, each flap becomes active as an air conducting member. Each of these swivel flaps 36' and 36" are supported at the longitudinal housing walls 3', 3" near the housing rear wall 2 due to the fact that the flap engages, by means of a longitudinal rim section 37 of circular cross-section, with the groove 11 which also has circular profile at the inside of the longitudinal housing wall as shown in FIG. 4. Each of these swivel flaps 36', 36" may be formed of an extruded profile such as of light metal or hard plastics. Each flap displays two faces 38', 39' or 38", 39" lying at an obtuse angle to one another. This obtuse angle is coordinated to the angle between the front face and the inclined longitudinal side of the insert body in the air distribution ducts 32', 32". The construction of these swivel flaps 36' and 36" is clearly illustrated in FIG. 3. The two swivel flaps 36', 36" can be adjusted independantly of one another between their closure position (shown at that the right in FIG. 3), and their open position (shown at the left in FIG. 3.) This is accomplished by means of a rotory button or toggle 40', 40" supported at the housing front wall 5 by a crankpin 41', 41". Each crankpin 41' or 42' passes through a circular slot 42' or 42" in the housing front wall 5 into a curved crank slot 43' or 43" which is located at the free leg 38', 38" of its respective swivel flap 36' or 36", as best seen in FIG. 1. The length of the crankpins 41', 41" is chosen so that they remain in constant engagement with the curved crank slots 43', 43" over the whole range of movement of the swivel flaps 36', 36".

It is often desirable or necessary to lay out ventilation apparatus for rooms in such a way that the air from outside is freed of particles of dust or noxious matter before it reaches the interior of the room. This can be accomplished in a simple manner through the use of a replacable filter insert 44 which is preferably designed and installed as indicated by dot-and-dash lines in FIG. 1 and 3. In this embodiment the filter insert 44 is located in the section 27 of the air conducting conduit 28 which is radially directed towards the enveloping spiral 21 in the block-like insert body 25. It has a lamellar structure in the form of a layered or folded filter material 45 having multiple zig-zags and formed, for example, out of paper fleece. The body is fastened along its longitudinal edges on to two thin supporting plates 46 and 47, of such a material as paper board. The filter insert 44 is enveloped for part of its height by a shoulder 48 which is equidistant from the inner boundary wall of the air conducting conduit section 27 which is formed in the insert body 25, as can be seen in FIG. 1 and 3. For the rest of its height the filter insert 44 projects freely into the zone of clearance 30', 30" which has been left free between the housing front wall 5 and the surface of the insert body 25 which turns towards it. This is clearly shown in FIG. 3.

The carrier plate 47 of the filter insert 44 is provided with a slot-like aperture 49 at which the layered body 45 of filter material is in contact with the air conducting conduit 28. It is through this slot-like aperture that the entering air encounters the filter surfaces which are formed by multiple folding, before the air arrives in the clearance area 30', 30" in the interior of the housing 1. The carrier plate 46 of the filter insert which is adjacent to the housing front wall 5 is preferably closed over its entire extent so that the air can flow from the filter insert only in a lateral direction into the interior of the housing one before it reaches the air passage openings (that is, the lattices of perforations 33', 33" in the longitudinal housing walls 3', 3".) Since the extruded profiles 5' and 5", which form the housing front wall 5, are connected in an easily removable manner to the longitudinal housing walls 3' and 3", the filter insert may be replaced without difficulty when necessary.

It should be pointed out that a ventilation appliance of the type described in detail above may also be laid out as a purely "pressure differential" ventilation appliance. For this application, it is sufficient to omit the blower wheel 20 and the electric motor 22 from the enveloping spiral 21 of the block-construction-type insert body 25. The use of such a pressure differential ventilation appliance is especially recommendable for rooms in which, on the one hand, a forced ventilation appliance of the type described above is being used, but which, on the other hand, because of highly efficient sealing action of built-in windows and doors, it is impossible to obtain a natural pressure balance. In such cases, in order to obtain a pressure balance it is necessary to arrange, in front of the forced ventilation appliance, a pressure diffferential appliance which is in all other respects identical. This pressure difference ventilation appliance is preferably built into a different room wall from that of the forced ventilation appliance. Since, in such a pressure differential ventilation appliance the holder plate 24 is not required to carry the stator 23 of the electric motor 22 and the blower wheel 20, it can be advantageous to reverse the relative positions of the plate-like flat insert body 29 and that of the holder plate 24 inside the housing 1. Thus, in such a pressure differential ventilation appliance the insert body 29 butts against the insert body 25, while the holder plate 24 is averted therefrom. Although it would be conceivable to eliminate totally the holder plate 24 made of non-absorbing material, it is found that a better sound damping effect is acheived when the holder plate 24 is retained (possibly because of the effect it has of weighing down the flat insert body 29).

The installation of the holder plate 24 and the insert body 29 in the position for a pressure differential ventilation appliances (which is the reverse of the arrangement shown in FIG. 2) presents no difficulties, since the installation space required for it in the housing 1 is the same and is already available.

The embodiment of the invention illustrated in the drawing and explained above in detail has, among its advantages, not only that it has a simple technical assembly and is therefore an especially maintainance-and repair-friendly design, but it also has the advantages of a structurally small dimensions, which allow a great through-put of air and insures thereby a good sound damping.

Figure 5:
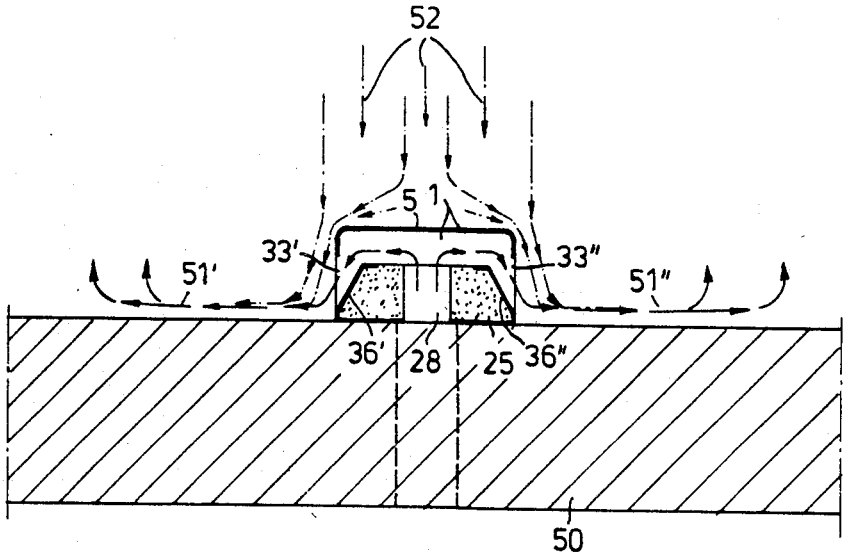
FIG. 5 illustrates an important characteristic of the flow pattern produced by this embodiment.

Upon actual installation of the ventilation equipment of the present invention on the inside wall of a room it has been found that the favorable effects of the characteristic design are enhanced upon installation. An indication of the enhanced effect is diagrammed in FIG. 5. When the swivel flaps 36' and 36'' are brought into open position as shown in FIG. 5, the air is forced into the room through the lattices of perforations 33' and 33''. The air stream is directed at an obtuse angle against the room wall 50 and is laterally deflected by the room wall. In part due to the Coanda effect, the air stream 51', 51'' lays itself out along the wall and tends to flow along the wall. Because of this particular flow of fresh air entering the room, a suction effect appears in the region in front of the wall 5 of the housing 1 directing the room air towards the wall 50 and up to the point of the front edge of the lattices of perforations 33' an 33'' towards the front wall 5. As the room air 52 is drawn in the direction of the wall 50 there is an intense turbulent mixing with the entering fresh air 51', 51''. Thus, in addition to the fact that the fresh air introduced into the interior of the room contributes to a substantial improvement in the quality of the room air, this phenomenon results in the considerable advantage that the existing room air transfers a significant portion of its thermal energy to the fresh air. Thus the fresh air which detaches from the room wall 50 will have obtained a higher temperature than its entry temperature. Thus, the ventilation equipment of the present invention tends to effectively eliminate disagreeable draft effects within a ventilated room.

It is obvious that minor changes may be may be made in the form and construction of the invention without departing from the materials' spirit thereof. It is not therefore desired to confine the invention to the exact form herein shown and described but it is desired to include all such as properly come within the scope claimed.

The invention having been thus described, but is claimed as new and desired to secure by letters patent is:

1. A ventilation appliance having a radial fan arranged in a box-shaped housing and having an insert body containing a spiral chamber encircling a blower wheel, the housing mountable on an extended surface by a rear wall and having two longitudinal side walls and a front wall facing away from the mounting surface characterized by the fact that the space between the insert body and the housing forms an air conducting conduit with tangential and radial sections and the chamber of the insert body has an outlet located adjacent the front wall and centrally disposed thereof and the radial sections of the air conducting conduit (32) are formed by two beveled sections of the insert body, the beveled sections being sloped from adjacent the front wall longitudinally toward each respective side wall and toward the rear wall and toward the mounting surface so that the radial sections of the air conduit run from the outlet of the insert body at a point adjacent the front wall (5) to the longitudinal side walls (3', 3'') rearwardly toward the mounting surface (50), the longitudinal side walls being provided with air outlets (33', 33'').

2. Ventilation appliance as recited in claim 1 characterized by the fact that a swivel air-control flap (36', 36'') is provided between each longitudinal side wall (3', 3'') and the facing beveled section (35', 35'') of the insert body (25), each flap provided in the region of the respective air outlet (33', 33'').

3. A ventilation appliance as recited in claim 2 characterized by the fact that the beveled sections of the insert body are formed by an angle between a front face and a side face of the insert body, and wherein each of said swivel flaps (36', 36'') is supported at the longitudinal side walls (3', 3'') adjacent to the housing rear wall (2) and comprises a profile having two faces (38', 39') at an obtuse angle to one another, wherein the angle corresponds to the angle between the front face of the insert body and the side face (35', 35'') of the insert body.

4. A ventilation appliance as recited in claim 3 characterized by the fact that each swivel flap (36', 36'') has a free face and is adjustable between an open position and a closed position by means of a crank pin (41', 41'') connected to a rotary button or toggle (40', 40'') that engages in a curved slot provided at the free face of the swivel flap.

5. Ventilation appliance as recited in claim 4 characterized by the fact that the longitudinal side walls (3', 3'') and the front wall (5) of the box-shaped housing are formed of extruded profiles of light metal or plastics while partitions (4', 4'') are provided which are die-cast of light metal or injection molded of plastic and wherein the rear wall (2) is a sheet metal, stamped-out part.

6. A ventilation appliance as recited in claim 5 characterized by the fact that the two longitudinal side walls (3', 3'') of the box-like housing (1) consist of mirror-image extruded profiles, and wherein the front wall is formed of two mirror-image opposed extruded profiles (5', 5'') coupled with each other by a supplementary extruded profile (5''').

7. A ventilation appliance as recited in claim 4 characterized by the fact that a replacable filter insert (44) is provided in the radial section of the air conducting conduit, the filter insert projecting partially into a zone of clearance between the insert body and the housing front wall.

8. A ventilation appliance as recited in claim 1 wherein said insert body is formed of sound-deadening material.

9. A ventilation appliance as recited in claim 8 wherein the cavity of the insert body includes an air intake connected to outside air and wherein the wall of the cavity opposite the air intake is formed of a separate, plate-like body of sound deadening material (29) at the inside of which abuts a holder plate (24) of reverberative material, the blower wheel being provided with a stator (23), the stator being mounted on the holder plate.

10. A ventilation appliance as recited in claim 9 wherein a layer of sound deadening material is provided along the radial section of the air-conducting conduit opposite the portions of the insert body which form the radial sections.

* * * * *